United States Patent [19]

Solimar

[11] Patent Number: 4,662,543

[45] Date of Patent: May 5, 1987

[54] AERATION DEVICE FOR ASSISTING IN AERATION OF MATERIAL FROM CONTAINERS

[76] Inventor: Keith F. Solimar, 1289 Brighton Sq., New Brighton, Minn. 55112

[21] Appl. No.: 779,225

[22] Filed: Sep. 23, 1985

[51] Int. Cl.[4] ..... B65G 69/06

[52] U.S. Cl. ..... 222/195; 366/107; 406/137

[58] Field of Search ..... 137/843, 852, 855, 860; 406/134, 136–137; 222/195, 196, 630, 101; 366/107

[56] References Cited

U.S. PATENT DOCUMENTS

| | | | |
|---|---|---|---|
| 3,424,352 | 1/1969 | Schlink | 222/195 |
| 3,645,583 | 2/1972 | Heath | 302/53 |
| 3,713,564 | 1/1973 | Cottrell | 222/1 |
| 3,929,261 | 12/1975 | Solimar | 222/195 |
| 3,952,956 | 4/1976 | Steele | 222/195 X |
| 4,030,755 | 6/1977 | Heimke | 222/195 X |
| 4,057,155 | 11/1977 | Deeks | 406/136 |
| 4,172,539 | 10/1979 | Botkin | 222/195 |

FOREIGN PATENT DOCUMENTS

| | | | |
|---|---|---|---|
| 1909219 | 9/1970 | Fed. Rep. of Germany | 222/195 |

*Primary Examiner*—Joseph J. Rolla
*Assistant Examiner*—Michael S. Huppert
*Attorney, Agent, or Firm*—Merchant, Gould, Smith, Edell, Welter & Schmidt

[57] ABSTRACT

An aeration device is disclosed for assisting discharge of material from containers. The device comprises a resilient flexible skirt member which has an inner conical surface and an outer conical surface. An anchor stud is disclosed for fastening the skirt member in the prestressed condition with the stud secured to a cup-shaped housing on an exterior of the container. A gas conduit connects an interior of the cup member and the pressure chamber with a source of a pressurized gas.

14 Claims, 7 Drawing Figures

AERATION DEVICE FOR ASSISTING IN AERATION OF MATERIAL FROM CONTAINERS

BACKGROUND OF THE INVENTION

I. Field of the Invention

This invention relates to a device for the introduction of air or other pressurized gas into dry bulk material to fluidize the material for efficient pneumatic transfer.

II. Description of the Prior Art

In the prior art, aeration devices are well known for use in pneumatic trailer tanks, rail cars, storage tanks and the like. Such devices introduce air into containers to aerate material stored within the containers. Such prior art devices may be porous to permit the flow of air through the device or may consist of flexible elements which provide a seal when air pressure is terminated but permit passage of air from the device into the container when air pressure is initiated. Examples of the latter may be found in U.S. Pat. No. 4,172,539 to Botkin dated Oct. 30, 1979 and my prior patent, U.S. Pat. No. 3,929,261 dated Dec. 30, 1975.

U.S. Pat. No. 4,172,539 teaches an aerator for a hopper container. The aeration device includes a body member having a radially projecting disk which is secured to an inner wall of a hopper by means of a cup on an exterior wall. The cup has a bolt which threadedly engages a stem portion of the disk extending through a hole in the container wall. The disk portion has an axially aligned retaining head which receives an axially aligned cylindrical central portion of a resilient skirt which rests upon the disk in face-to-face relationship. A plurality of bores extends through the disk portion providing gas flow communication between the cup and a manifold defined between the disk and the skirt. When pressurized air is admitted to the cup, the air passes through the bore and into the manifold and forces the skirt away from the disk whereby the air flows into the container to aerate material therein. In addition to the embodiment just described, U.S. Pat. No. 4,172,539 discloses alternative embodiments all of which show a resilient skirt member which rests in face-to-face relation over a solid member and covering air passages between a pressurized source and an interior of the container.

U.S. Pat. No. 3,929,261 was issued to me on Dec. 30, 1975. The patent teaches an aeration device which comprises a cone-shaped support which is affixed to the wall of a container and extends into the interior of the container. The device has an air inlet on an end adapted to be connected to a source of air exterior of the container. The cone-shaped support has a plurality of holes extending through its conical walls. A cone-shaped flap, shaped complementary to the support, is closely fitted onto the support with the flap closing the holes. The flap has an open large diameter end adjacent the container wall which flexes away from the support when pressurized air is admitted to the cone-shaped support. When the flap so flexes, air passes through the openings in the cone walls and passes between the cone and the flap toward the container wall and into the container to aerate material within the container. To secure the cone-shaped support against the interior of the container wall, a cup member is provided on an exterior of the wall which surrounds an extending end of the cone-shaped support passing through a hole in the container wall. The cup member is provided with an inlet fitting connected to a source of pressurized air. Additionally, the cup member is provided with a threaded fastener extending through a hole in the cup-shaped member and axially aligned with an interior threaded portion of an extending end of the cone-shaped support. The threaded fastener engages the interior threads and draws the cone-shaped support tightly against the container wall.

While the prior art teaches aeration devices such as those described above, there is a continuing need in the art for improvements in aeration devices. Certain problems which continue to plague the art include contamination of the aeration device by pulverulent material within the containers. Such material migrates into the aerator when air flow through the aerator is discontinued or during loading of the material into the container. Also, the restricted flow passages of the prior art aeration devices can generate undesirable back pressure within the aerators. Another problem associated with the prior art is that the flexible skirts of the prior art may reverse and stay reversed thereby exposing the aerator holes when air is not passing through the holes. Finally, many of the prior art devices incorporate the above problems while having an additional problem of taking up a substantial amount of space within the container. The physical dimensions of such aerators present a greater area to be bombarded by pulverulent and abrasive material when it is admitted into the container thereby increasing the possibility of damage to the aerator device over a relatively short period of time.

OBJECTS AND SUMMARY OF THE INVENTION

It is an object of the present invention to provide an aeration device to assist in the discharge of material from containers where the aeration device abates passage of material from the interior of the container into the aeration device.

A further object of the present invention is to provide an aeration device having a flexible skirt member which is prestressed to retain its shape in sealing engagement against the container walls when air is not passing through the aerator.

A yet further object of the present invention is to provide an aeration device having a flexible skirt member which is retained against a container wall in a prestressed state with the skirt presenting a contour when in the prestressed condition which directs material flow away from a seam defined between the skirt and the container wall.

A still further object of the present invention is to provide an aeration device which is easily and economically fabricated.

An again further object of the present invention is to provide an aeration device which includes a skirt member which is readily adaptable to existing aeration device hardware and, more particularly, which is readily adaptable to retrofit existing cup members and fastening devices as shown in my U.S. Pat. No. 3,929,261.

According to a preferred embodiment of the present invention there is provided an aeration device for assisting discharge of materials from containers. The device comprises a generally conical skirt member which is formed of resilient material and having an inner conical surface and an outer conical surface which are axially aligned when the skirt member is in a relaxed state. An anchor stud is provided for securing the skirt member to an inside surface of a container wall with a base end of the skirt member opposing the inside surface and with the anchor drawing the skirt axially toward the wall to prestress the skirt member. The prestressed skirt member presents a generally convex inner surface spaced away from the wall and cooperating with the inside wall to define a pressure chamber. Means are provided for supplying a flow of a pressurized gas from a source exterior of the container to the chamber.

DESCRIPTION OF THE PREFERRED EMBODIMENT

Figure 6:
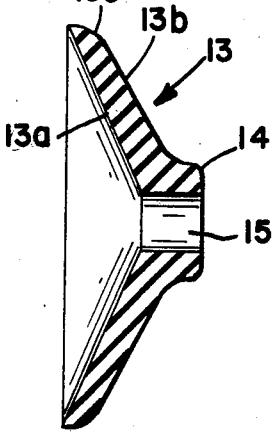
FIG. 6 is a cross sectional view of a resilient skirt member for the aeration device of the present invention.
Figure 3:
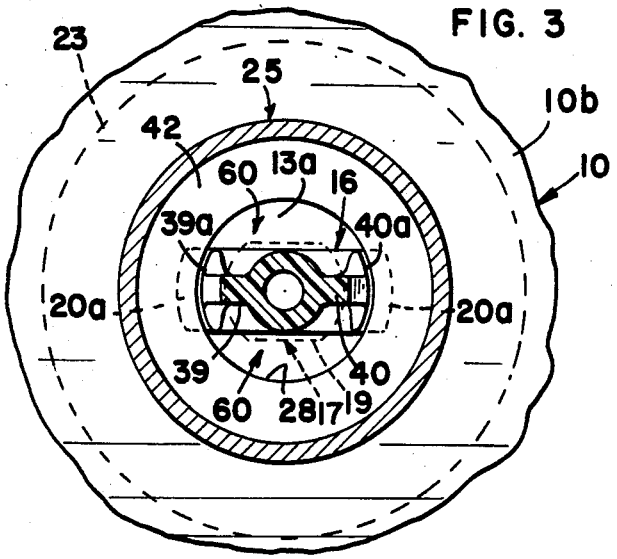
FIG. 3 is a view of an aeration device taken along line III—III of FIG. 1.

In the drawings, where like reference numerals indicate like parts throughout the several views, a hopper or container is provided with a curved wall 10 having a concave inside surface 10*a* and a convex outside surface 10*b*. The inside surface 10*a* of the wall 10 defines a container interior 11. An aeration device, shown generally at 12, is provided for admitting pressurized air into the interior 11 of the container. The aeration device includes a generally conical skirt member 13. As shown best in FIG. 6, the skirt member is formed of flexible resilient material (preferably silicon rubber to withstand elevated temperatures) and has an inner conical surface 13*a* and an outer conical surface 13i which is generally parallel to and axially aligned with the inner surface 13*a*. The skirt member further includes a cylindrical axially extending cap 14 having an axially extending bore 15 therethrough. The large diameter portion or base of inner conical surface 13*a* and outer conical surface 13*b* are joined by a generally vertical convex surface 13*c* at an outer periphery of the skirt member. As shown in FIG. 6, the skirt member 13 is in a relaxed state. That is, the view of FIG. 6 shows the shape assumed by the skirt member 13 when no external forces are imposed upon the skirt member.

Figure 1:
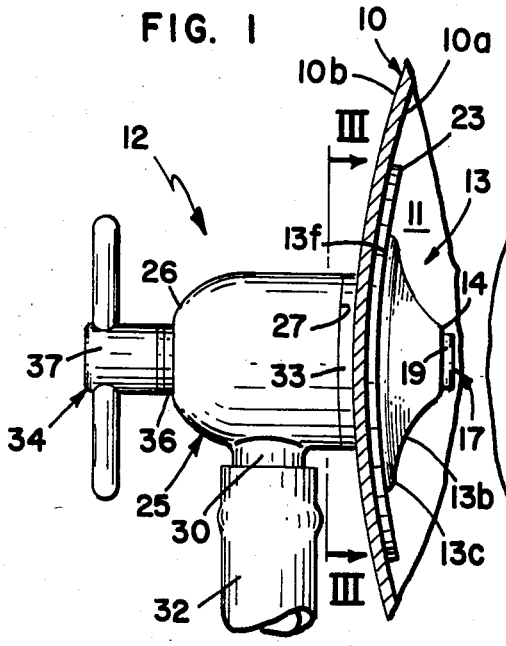
FIG. 1 is a view of an aeration device according to the present invention secured to the wall of a material container.
Figure 2:
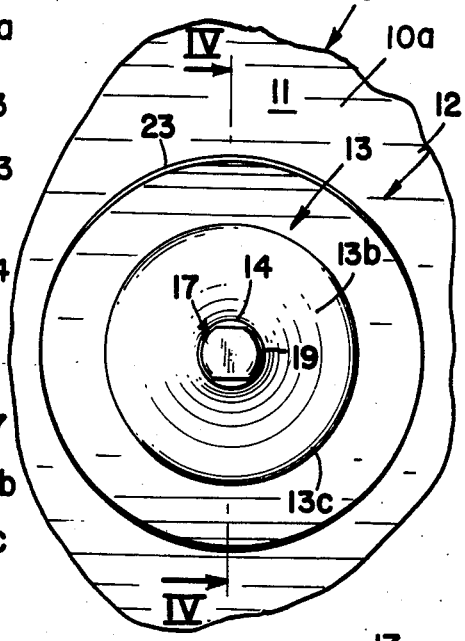
FIG. 2 is a view of an aeration device according to the present invention taken from an interior of a container.
Figure 7:
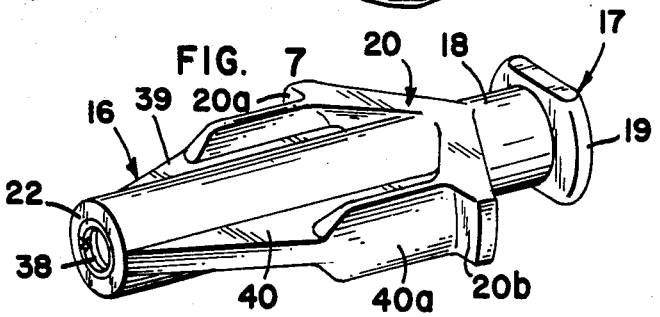
FIG. 7 is a perspective view of an anchor stud for an aeration device of the present invention.
Figure 4:
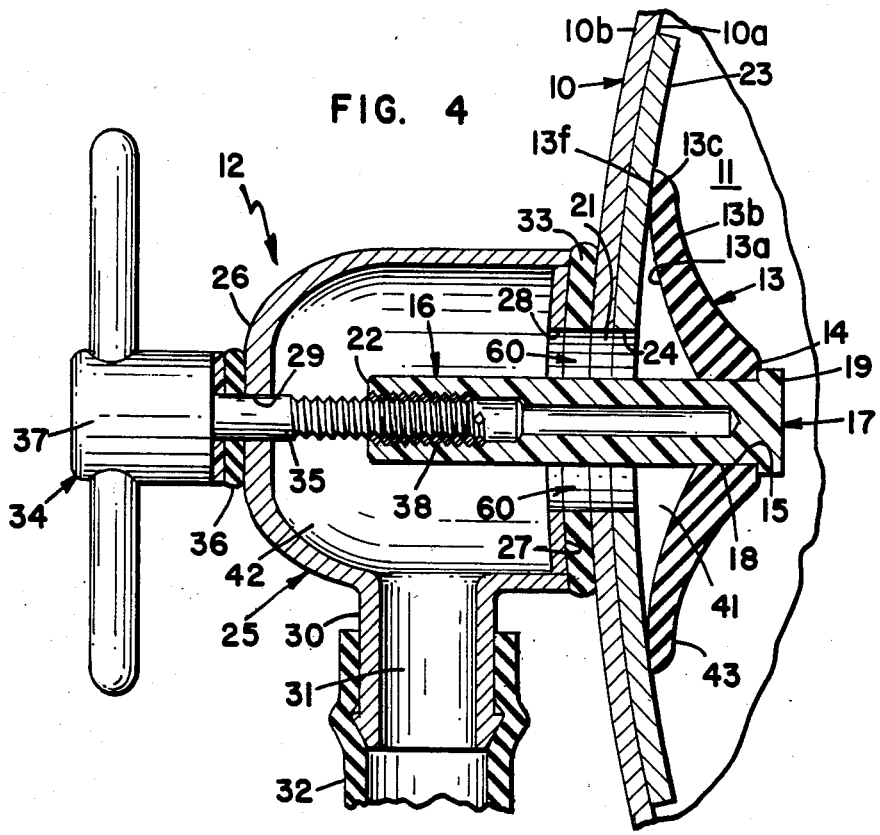
FIG. 4 is a cross sectional view of an aeration device of the present invention taken along lines IV—IV of FIG. 2.
Figure 5:
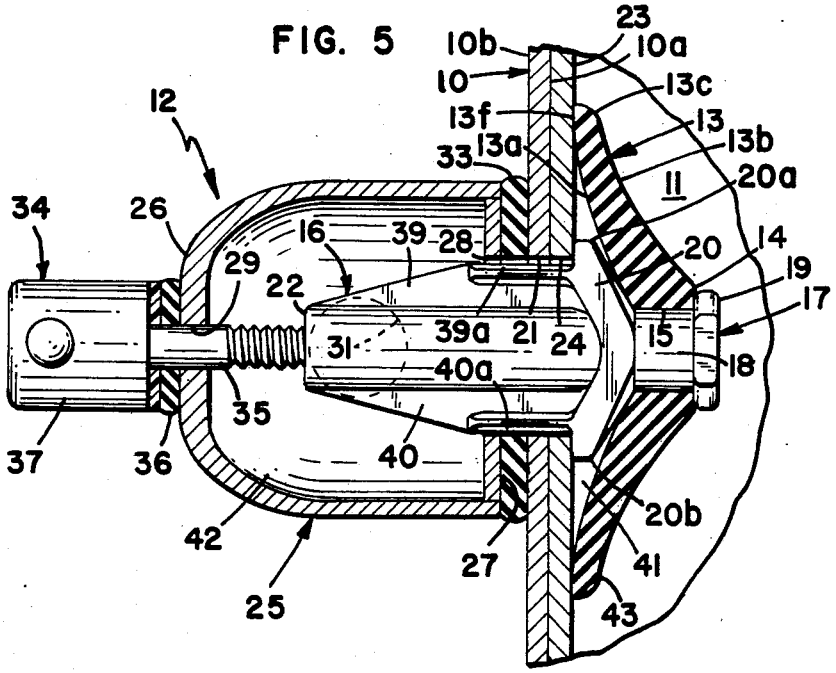
FIG. 5 is a view taken in cross section of an aeration device of the present invention taken 90 degrees to the side of FIG. 4.

Referring now to FIGS. 4, 5 and 7, an anchor stud is provided shown generally at 16. The stud 16 includes a head end 17 having a cylindrical neck portion 18 sized to have a diameter approximately equal to the diameter of the bore 15 of the skirt member cap 14. The head end is further provided with a radially outwardly projecting flange 19 at a terminating end of the anchor stud 16. As shown in the Figures, the resilient skirt member 13 is received on the anchor stud 16 with the cap 14 surrounding the neck 18 of the stud 16. The resilient skirt member 13 is secured from moving axially on the stud 16 by means of the flange 19 and a shoulder 20 which shoulder also acts as a spacer as will be described more fully hereafter. The stud 16 extends axially away from the head end 17 and through an opening 21 formed through the container wall with the stud terminating at a second end 22.

As shown in the drawings, the aeration device is provided with a wear plate 23 which is sized to have an area greater than an area of the base of the skirt member 13 and with a surface of the wear plate shaped to conform with the inside surface 10*a* of the container wall 10. The wear plate is provided with a hole 24 therethrough which is sized to conform with the hole 21 through the container wall and aligned therewith. The wear plate is to provide a wearing surface between the skirt member 11 and the container wall 10. Such a plate 23 is part of a preferred embodiment but is not necessary to the operation of the aerator. That is, the skirt 13 could abut surface 10*a* directly without the need for an intermediate plate 23.

To secure the skirt 13 in a desired position, a fastening means is provided comprising a cup-shaped housing 25 having a closed end 26 and a slightly concave annular end surface 27 with an opening 28 formed therethrough sized to conform with and align with hole 24 and wall opening 21. As shown in the Figures, the cup-shaped housing 25 surrounds the second end 22 of stud 16. The closed end 26 of the cup-shaped housing 25 is provided with an axially extending opening 29 which is axially aligned with openings 21, 24 and 28 and further axially aligned with the cup portion 14 and bore 15 of skirt member 13. A radially extending inlet fitting 30 projects from one side of the housing 25 and has a bore 31 therethrough for flow of air from a conduit 32 connected to a source of pressurized gas such as air (not shown). An annular sealing gasket 33 is provided disposed between the outer surface 10*b* of wall 10 and the end 27 of housing 25 to provide an air tight seal between the surfaces.

A fastener, shown generally at 34, is provided having an elongated shaft 35 threaded at its free end. The shaft is slidably received through opening 29 of housing 25 and extends in axial alignment with the bore 15 of skirt cup 14. An annular sealing gasket 36 is disposed between a handle portion 37 of fastener 34 and opposing surfaces of the closed end 26 of cup-shaped housing 25. Anchor stud 16 is preferably fabricated from glass reinforced nylon molded with a threaded metal insert 38 at the second end 22 of the stud. The threaded metal insert 38 is axially aligned with both shaft 35 of fastener 34 and bore 13 of skirt cup 14 with threaded shaft 35 threadably received within the threaded metal insert 38.

Anchor stud 16 is provided with a pair of opposed radially projecting and axially extending ribs 39 and 40. The ribs have outer surfaces 39*a* and 40*a* which oppose surfaces of the container wall 10 and wear plate 23 defining openings 21 and 24, respectively. The outer surfaces 39*a* and 40*a* are spaced apart a distance approximately equal to the spacing of the hole defining surfaces and are contoured to present a surface complementary to opposing surfaces. In the preferred embodiment as shown, the openings 21 and 24 are circular and the surfaces 39*a* and 40*a* of the ribs 39 and 40 are spaced apart a distance equal to the diameter of the openings and are curved to have a radius of curvature approximately equal to the radius of the openings.

As mentioned above, the anchor stud 16 includes a shoulder 20 for bracing cap 14 of skirt 13 between a shoulder 20 and flange 19. The shoulder 20 also includes a pair of radially extending spacers 20*a* and 20*b*. Spacers 20*a* and 20*b* extend radially from the axis of the bore 13 a distance greater than the radius of the openings of 21 and 24. Spacers 20*a* and 20*b* are provided with an axial dimension sufficient to prevent axial movement of the anchor and skirt member 13 from moving toward wall 10 past a predetermined position with the skirt member 13 being prestressed when in the position.

Referring to FIGS. 4 and 5, the aeration device is shown assembled attached to a container wall 10 with threaded shaft 35 of fastener 34 engaging the threaded metal insert 38 of anchor stud 16. As handle 37 is turned, the turning of threaded shaft 35 draws the anchor stud 16 toward the handle 37 with anchor stud 16, in turn, drawing the skirt member 13 toward wall 10. As the skirt member 13 is drawn toward wall 10, the skirt member abuts wear plate 23 and deforms as the anchor stud 16 continues to move toward handle 37 until stops 20*a* and 20*b* abut the wear plate 23 at which point the skirt member 13 achieves a desired prestressed state as shown in FIGS. 4 and 5. When in the prestressed state, the skirt member 13 has deformed to the point that its inner surface 13*a* is convex with a radially outer portion 13*f* abutting wear plate 23. For purposes of this discussion, the term convex inner surface will mean a conical inner surface having convex walls. Likewise, the outer surface 13*b* has deformed such that the surface is concave which for purposes of this discussion will mean a cone having concave walls. As can be seen in FIGS. 4 and 5, when the skirt member is in the desired prestressed state, the shoulder stops 20*a* and 20*b* prevent the skirt member from resting on the wear plate 23 in a face-to-face condition with the now convex surface 13*a* and opposing upper surface of the wear plate 23 defining a pressure chamber 41 in gas flow communication with an interior 42 of cup housing 25. Also, when the skirt 13 is in the prestressed condition as shown, the generally vertical convex surface 13*c* of the skirt member 13 provides a rounded ridge from the surface of wear plate 23 to a generally flat portion 43 of the upper concave surface 13*b* near the periphery of the skirt 13.

In operation of an aeration device according to the present invention, the interior 11 of the container is filled with material. When it is desired to discharge the material from the container, air is admitted under pressure through conduit 32 into housing 25. The air flows through unobstructed spaces 60 between the anchor stud 16 and opposing hole defining surfaces of the wall 10 and wear plate 23 into pressure chamber 41. Air pressure within pressure chamber 41 slightly lifts the peripheral edge of skirt member 13 and vibrates it with air flowing through a seam defined between the periphery of skirt member 13 and the upper surface of wear plate 23. The air flows into the material and aerates it to facilitate discharge of the material from the container. Likewise, the movement of the skirt member 13 aids in breaking up any caked material which may surround skirt member 13.

When air pressure through conduit 32 is reduced, the skirt 13 resumes the configuration shown in FIG. 4. The peripheral edge of the skirt member 13 closes quickly to present a closed seam between the skirt member 13 and the wear plate 23. The quick closing of the skirt member 13 is credited to both the weight of any material on skirt member 13 urging it to a closed position but, more importantly, to the fact that the skirt member is prestressed by anchor bolt 16. The prestressing of the skirt member 13 in the closed position also avoids contamination of the aeration device by material when the container is being loaded. This is additionally supported by means of the rounded convex periphery 13*c* which directs material away from the seam between the skirt member 13 and wear plate 23 and directs material onto the concave surface 13*b*. The aeration device of the present invention, in addition to effectively avoiding contamination of the device by stored material, also results in less back pressure since air flow passes on the sides of the anchor stud 16 rather than through any restrictive air passage formed by means of a hole through a stem. Also, the skirt member 13, due to its prestressed state, cannot deform such that it reverses to stay in a reversed position exposing the pressure chamber 41 to the interior 11 of the container.

Having described the present invention by way of the preferred embodiment, it can be seen how the objects of the invention have been attained. As this invention may be embodied in several forms without departing from the spirit of the invention, the present embodiment is therefore illustrative and not restrictive since the scope of the invention is defined by the appended claims and includes such equivalent forms as will be apparent to those skilled in the art.

What I claim is:

1. An aeration device for assisting discharge of materials from containers comprising a generally conical skirt member formed of flexible resilient material and having an inner conical surface and an axially aligned outer conical surface;

anchor means for securing said skirt member to an inside surface of a container wall with a base end of said shirt member opposing said inside surface and with said anchor means drawing said skirt member axially toward said wall to prestress said skirt member with said prestressed skirt member presenting a generally convex inner surface cooperating with said inside wall to define a pressure chamber between said skirt member and said inside wall;

said base end of said skirt member having an outer periphery shaped to direct a flow of material away from a seam defined by a juncture of said base end and said inside surface of said container wall when said skirt member is prestressed;

means for supplying a flow of a pressurized gas from a source to said chamber;

said base end of said skirt member being free of rigid attachment to said anchor means for flexing movement of said base end toward and away from said inside wall of said container to alternatively close and open gas flow communication between an interior of said container and said pressure chamber;

whereby flow of pressurized gas from said source into said chamber induces flexation of said base end of said skirt member away from said inside wall whereby said gas flows radially from said pressure chamber into said container interior along said inside wall and into material stored within said container to aerate said material and said outer periphery of said base end directs material away from said seam to avoid contamination of said pressure chamber.

2. An aeration device according to claim 1 wherein said device is mounted in an interior of a container with said anchor means comprising an anchor stud having a head end fastened to said skirt member with said anchor stud extending axially from said base end of said skirt member through a hole formed in said container wall and terminating at a second end outside of said container;

fastening means outside of said container for engaging said anchor stud and drawing said anchor stud axially toward said container wall;

said anchor stud provided with spacer means for stopping axial movement of said anchor in a predetermined position with said skirt member prestressed.

3. An aeration device according to claim 2 wherein said anchor stud is provided with opposed radially projecting and axially extending ribs having outer surfaces opposing a surface of said container wall defining said hole and said ribs sized to provide a distance between said ribs approximately equal to a distance between hole defining surfaces of said container wall.

4. An aeration device according to claim 3 wherein said outer surfaces of said ribs are contoured to present a surface complementary to said hole defining surfaces of said wall.

5. An aeration device according to claim 2 wherein said skirt is provided with a cylindrical axially extending cap opposite said base end with said cap having an axially extending bore therethrough;

said head end of said anchor stud having a cylindrical neck portion sized to have a diameter approximate to said bore and received within said bore;

said head end having a radially outwardly projecting flange on an end thereof with said cap received on said neck and retained on said neck by said flange.

6. An aeration device according to claim 2 wherein said fastening means includes a cup-shaped housing engaged against an outside surface of said container wall and in surrounding relation to said second end of said anchor stud;

an inlet fitting on said cup-shaped member for attachment thereto of a suitable source of a gas under pressure;

a thereaded fastener extending through an opening in said cup-shaped member into threaded engagement with said free end of said anchor stud to draw said free end and cup-shaped member toward one another on opposite sides of said wall of said container to securely position said aeration device in said container with said spacer means stopping said anchor stud with said skirt member in said prestressed position.

7. An aeration device according to claim 1 wherein said outer conical surface of said skirt member and said inner conical surface are joined at said outer periphery of said skirt member by a surface extending away from said seam and toward an axis of said conical surfaces.

8. An aeration device according to claim 2 wherein said device includes a wear plate having a first surface with an area greater than an area of said skirt member and with a second surface shaped to comform with said inside surface of said container wall;

said wear plate having a hole aligned with said hole through said container wall and said anchor stud extending through both holes with said stop means abutting said wear plate and said skirt member abutting said wear plate.

9. A gas distributor for an aeration device for mounting on a container wall having an inside surface and an outside surface with a hole formed through said wall;

said device having fastening means comprising a cup-shaped housing engaged against said outer surface surrounding said hole;

an inlet fitting on said cup-shaped member for attachment thereto of suitable source of a gas under pressure;

a threaded fastener extending through an opening in said cup-shaped member;

said gas distributor comprising a generally conical skirt member formed of flexible resilient material and having an inner conical surface and an outer conical surface axially aligned with said inner surface;

an anchor stud for securing said skirt member to said inside surface of said container wall with a base end of said skirt member opposing said wall;

said anchor having a head end fastened to said skirt member and extending axially away from said base through said hole in threaded engagement with said threaded fastener for drawing said stud and skirt member toward said wall;

said anchor stud provided with spacers for stopping axial movement of said stud at a predetermined position with said skirt member prestressed to present a generally convex inner surface opposing said wall inside surface to define a pressure chamber in gas flow communication with said cup member; and said base end of said skirt member having an outer pheriphery shaped to direct a flow of material away from a seam defined by a juncture of said base end and said wall when said skirt member is prestressed.

10. A gas distributor according to claim 9 wherein said anchor stud is provided with opposed radially projecting and axially extending ribs having outer surfaces opposing a surface of said container wall defining said hole and said rib sized to provide a distance between said ribs approximately equal to a distance between said hole defining surfaces.

11. A gas distributor according to claim 10 wherein said outer surface of said ribs are contoured to present a surface complementary to said hole defining surfaces.

12. A gas distributor according to claim 9 wherein said skirt member is provided with a cylindrical axially extending cap opposite said base with said cap having an axially extending bore therethrough;

said head end of said anchor stud having a cylindrical neck portion sized to have a diameter approximate to said bore and to be received therein;

said anchor head end having a radially outwardly projecting flange with said cap received on said neck and retained on said neck by said flange.

13. A gas distributor according to claim 9 wherein said outer conical surface of said skirt member and said inner conical surface are joined at said outer periphery of said skirt member by a surface extending away from said seam and toward an axis of said conical surface.

14. A gas distributor according to claim 9 wherein said distributor includes a wear plate having a first surface with an area greater than an area of said skirt member and with a second surface shaped to conform with said inside surface of said container wall;

said wear plate having a hole therethrough aligned with said hole through said container wall and said anchor stud extending through both holes with said stop means and said skirt member abutting said wear plate.

* * * * *